US008152161B2

(12) United States Patent
Samoto et al.

(10) Patent No.: US 8,152,161 B2
(45) Date of Patent: Apr. 10, 2012

(54) IMAGE PRINTING DEVICES THAT PERFORM DUPLEX PRINTING

(75) Inventors: Kenji Samoto, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/051,826

(22) Filed: Mar. 18, 2011

(65) Prior Publication Data

US 2011/0309564 A1 Dec. 22, 2011

(30) Foreign Application Priority Data

Jun. 17, 2010 (JP) ..... 2010-138784

(51) Int. Cl.
*B65H 29/00* (2006.01)

(52) U.S. Cl. ..... 271/186; 271/3.14; 271/225; 271/902; 399/401

(58) Field of Classification Search ..... 271/3.14, 271/225, 186, 902; 399/401
See application file for complete search history.

(56) References Cited

U.S. PATENT DOCUMENTS

| | | | | |
|---|---|---|---|---|
| 6,185,381 | B1 * | 2/2001 | Nakahara et al. | 271/258.01 |
| 2007/0147921 | A1 * | 6/2007 | Chae | 399/401 |
| 2008/0179822 | A1 * | 7/2008 | Tu | 271/186 |
| 2010/0079529 | A1 | 4/2010 | Ito et al. | |

FOREIGN PATENT DOCUMENTS

| | | |
|---|---|---|
| JP | 2007-217179 A | 8/2007 |
| JP | 2010-082831 A | 4/2010 |

* cited by examiner

*Primary Examiner* — Gerald McClain
(74) *Attorney, Agent, or Firm* — Baker Botts L.L.P.

(57) ABSTRACT

A printing device includes a first transporting mechanism driven by a first motor, a printing unit, a second transporting mechanism configured to transport the printing medium transported by first transporting mechanism and is performed image printing on a first surface thereof by the printing unit, to the first transporting mechanism. The first transporting mechanism includes first transporting rollers disposed at a position upstream of the printing unit, and further includes second transporting rollers disposed at a position downstream of the printing unit and configured to rotate in both directions. The second transporting mechanism includes third transporting rollers driven by a second motor and configured to transport the printing medium switched back by the second transporting rollers toward the first transporting rollers. A transporting force of the second transporting rollers is smaller than a transporting force of the third transporting rollers.

10 Claims, 9 Drawing Sheets

IMAGE PRINTING DEVICES THAT PERFORM DUPLEX PRINTING

CROSS REFERENCE TO RELATED APPLICATION

The present application claims priority from Japanese Patent Application No. 2010-138784, filed on Jun. 17, 2010, the disclosure of which is incorporated herein by reference in its entirely.

BACKGROUND

1. Technical Field

The present invention relates to an image printing device which performs a duplex printing.

2. Related Art

In the related art, an image printing device configured to perform image printing on both surfaces of a printing paper is known. In the image printing device, the printing paper transported to a printing unit and subjected to the image printing on a first surface thereof through a transporting path defining a U-turn path is subjected to a switchback transport via a transporting path connecting a downstream side and an upstream side of the printing unit, and the printing paper entered again the transporting path is positioned with a second surface thereof opposing the printing unit, so that the printing unit performs the image printing on the second surface.

A plurality of roller pairs configured to hold and transport the printing paper are arranged in the transporting path. The transporting roller pairs include some transporting roller pairs being rotated in the same direction by a drive transmission from a common motor. Therefore, if the transporting roller pairs for the switchback transport of the printing paper backward are rotated in the reverse direction, other transporting roller pairs are rotated in the reverse direction. If the plurality of transporting roller pairs that hold and transport a single printing paper simultaneously are rotated in the opposed direction when the switchback transport of the printing paper is performed, the printing paper is pulled by the plurality of transporting roller pairs. In order to solve the problem as described above, a means to release the drive transmission to one of transporting roller pairs when the other transporting roller pair is rotated is known.

However, providing a mechanism for releasing the drive transmission considering the directions of rotation of the transporting roller pairs in duplex printing may increase complication of the mechanism and increase cost.

SUMMARY

A need has arisen to provide the printing device which may perform the duplex printing with a reduced complication of the mechanism and reduced cost.

According to an embodiment of the present invention, the printing device comprises a first transporting mechanism configured to transport a printing medium along a first path and a printing unit configured to perform image printing on the printing medium transported by the first transporting mechanism. The printing device further comprises a second transporting mechanism configured to transport the printing medium, which is transported by first transporting mechanism and is performed image printing on a first surface thereof by the printing unit, to the first transporting mechanism along a second path. The first transporting mechanism includes first transporting rollers disposed at a position upstream of the printing unit and configured to transport the printing medium toward the printing unit. The first transporting mechanism further includes second transporting rollers disposed at a position downstream of the printing unit and configured to transport the printing medium, which is performed the image printing on the first surface thereof, in a first direction and then in a second direction opposite to the first direction. The first transporting mechanism still further includes a first drive motor which rotates in a first rotational direction and a second rotational direction. Moreover, the first transporting mechanism includes a transmitting mechanism configured to transmit a rotation in the first rotational direction of the first drive motor to both the first transporting rollers and the second transporting rollers such that the first transporting rollers transport the printing medium toward the printing unit and the second rollers transport the printing medium in the first direction along the first path, and further configured to transmit a rotation in the second rotation direction of the first drive motor to both the first transporting rollers and the second transporting rollers such that the second transporting rollers transport the printing medium in the second direction. The second transporting mechanism includes a second drive motor and third transporting rollers configured to be driven by the second drive motor and configured to transport the printing medium, which is transported in the second direction by the second transporting rollers, toward the first transporting rollers along the second path. A transporting force of the second transporting rollers for transporting the printing medium in the first direction is smaller than a transporting force of the third transporting rollers for transporting the printing medium.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF PREFERRED EMBODIMENTS

Figure 1:
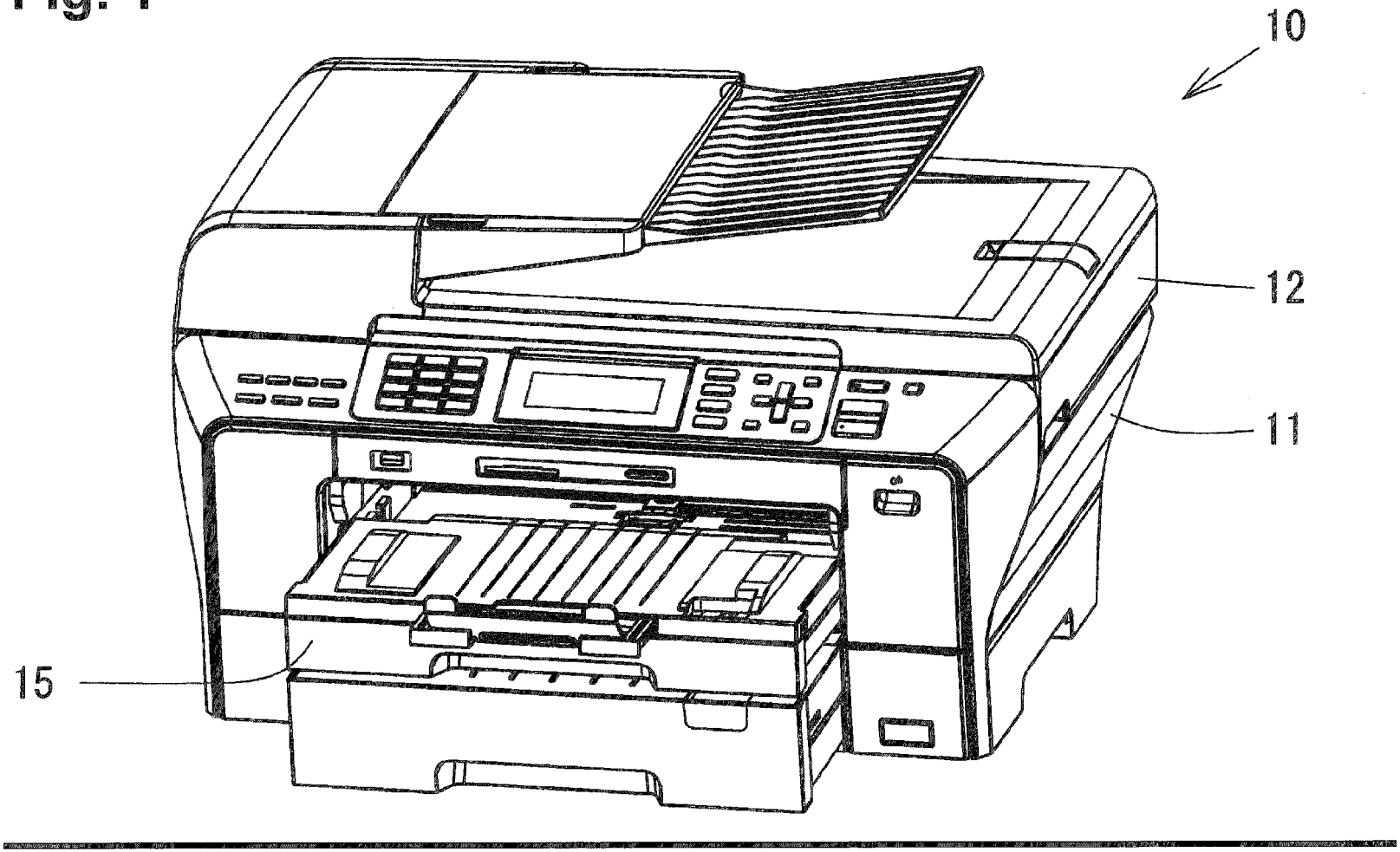
FIG. 1 is a perspective view showing an appearance configuration of a multifunction apparatus.

Embodiments of the invention and their features and advantages may be understood by referring to FIGS. 1-9, like numerals being used for like corresponding parts in the various drawings. Referring now to the drawings as needed, embodiments of the invention will be described. Needless to say, the embodiments described below are examples in which the invention is embodied, and the embodiments may be modified as needed without changing the scope of the invention.

[Outline of Multifunction Apparatus 10]

As shown in FIG. 1, a multifunction apparatus 10 (an example of a printing device) includes a printer unit 11 arranged on a lower side and a scanner unit 12 arranged on an upper side. The printer unit 11 is configured to print an image by selectively ejecting ink droplets on a printing paper on the basis of an ink jet printing system. The printer unit 11 is capable of performing the switchback transport of the printing paper backward to print the images on both surfaces of the printing paper. Detailed description of the scanner unit 12 is omitted in this specification.

[Printer Unit 11]

Figure 2:
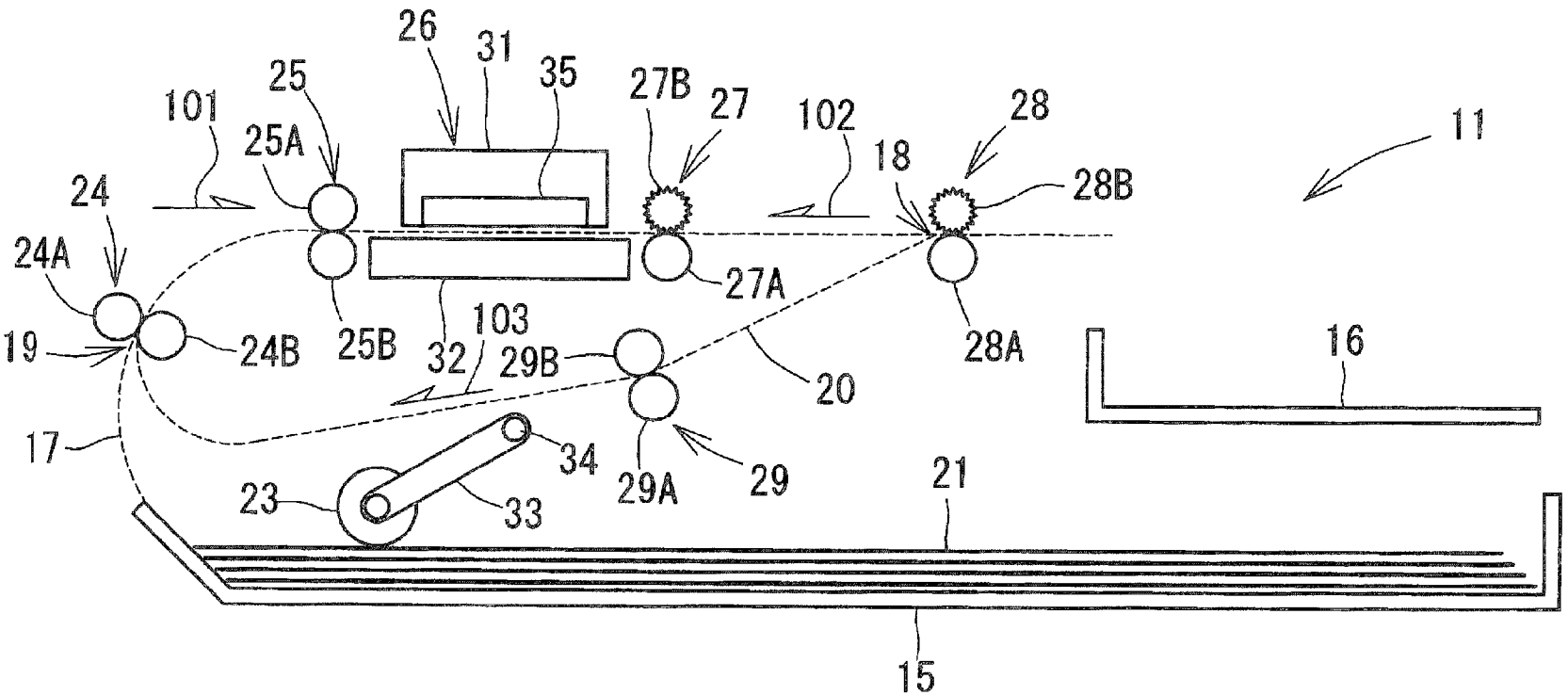
FIG. 2 is a diagrammatic drawing showing an internal structure of a printer unit.

As shown in FIG. 2, the printer unit 11 includes a first transporting path 17 continuing from a paper feed tray 15 (an example of a feed tray) to a paper discharge tray 16. The first transporting path 17 is a route where a printing medium such as a printing paper 21 subjected to image printing is transported.

On the first transporting path 17, an intermediate roller pair 24 (an example of a forth transporting rollers), a PF roller pair 25 (an example of a first transporting rollers), a printing unit 26, an EX roller pair 27 (an example of a fifth transporting rollers), and an SB roller pair 28 (an example of a second transporting rollers) are arranged in sequence from the upstream side of a first direction 101 directed from the paper feed tray 15 to the paper discharge tray 16.

The first transporting path 17 defines so-called a U-turn path which is bent upward from the paper feed tray 15 and makes a U turn. The intermediate roller pair 24 is arranged at a position where the first transporting path 17 is bent. The PF roller pair 25 is arranged at a position where bending of the first transporting path 17 is terminated. The first transporting path 17 defines a linear, so-called, a straight path after having bent and made the U-turn. The printing unit 26, the EX roller pair 27, and the SB roller pair 28 are arranged in the straight path, respectively. The intermediate roller pair 24, the PF roller pair 25, and the EX roller pair 27 transport the printing medium on the first transporting path 17 in the first direction 101. The SB roller pair 28 transports the printing medium selectively on the first transporting path 17 in the first direction 101 and a second direction 102 opposite from the first direction 101.

The printer unit 11 includes a second transporting path 20 which couples a downstream position 18 between the EX roller pair 27 and the SB roller pair 28 and an upstream position 19 between the paper feed tray 15 and the intermediate roller pair 24 on the first transporting path 17. The second transporting path 20 is a route where the printing medium such as the printing paper 21 to be subjected to the image printing is transported, and specifically, the printing medium which is to be subjected to the image printing on the both surfaces is transported.

A DX roller pair 29 (an example of the third transporting rollers) is arranged in the second transporting path 20. The DX roller pair 29 transports the printing medium in a third direction 103 directed from the downstream position 18 to the upstream position 19 in the second transporting path 20.

In the second transporting path 20, a route directed from the SB roller pair 28 to the DX roller pair 29 is the linear straight path. A portion near the upstream position 19 on the second transporting path 20 is bent upward, and is set to join the upstream position 19 at a curved portion of the first transporting path 17 at an angle as small as possible.

A paper feed roller 23 (an example of a feed roller) is arranged on the upper side of the paper feed tray 15. The paper feed roller 23 is provided rotatably on the distal end side of an arm 33. The proximal side of the arm 33 is rotatably provided about a shaft 34 as an axis of rotation. The paper feed roller 23 moves toward and away from the paper feed tray 15 by the arm 33 being rotated about the shaft 34 as the axis of rotation. The arm 33 is rotated toward the paper feed tray 15 by the weight of the paper feed roller 23. Accordingly, the paper feed roller 23 comes into contact with a topmost printing paper 21 from among a plurality of printing papers 21 placed on the paper feed tray 15 in a stacked state.

The intermediate roller pair 24 includes a drive roller 24A arranged outside of the curve of the first transporting path 17 and a driven roller 24B arranged inside the curve. Although the detailed description will be given later, the drive roller 24A is rotated by a drive transmission from a second drive motor 42. The driven roller 24B is provided so as to be movable toward and away from the drive roller 24A, and is resiliently urged toward the drive roller 24A. When the driven roller 24B is retracted from the drive roller 24A by an extent corresponding to the thickness of the printing paper 21 and urges the printing paper 21 toward the drive roller 24A, the printing paper 21 is held between the drive roller 24A and the driven roller 24B. Then, when the drive roller 24A is rotated, the printing paper 21 is transported according to the direction of rotation. The driven roller 24B is also rotated with the transport of the printing paper 21.

The PF roller pair 25 includes a drive roller 25A arranged on an upper side of the first transporting path 17 and a driven roller 25B arranged on a lower side thereof. Although the detailed description will be given later, the drive roller 25A is rotated by a drive transmission from a first drive motor 41. The driven roller 25B is provided so as to be movable toward and away from the drive roller 25A, and is resiliently urged toward the drive roller 25A. When the driven roller 25B is retracted from the drive roller 25A by the extent corresponding to the thickness of the printing paper 21, and urges the printing paper 21 toward the drive roller 25A, the printing paper 21 is held between the drive roller 25A and the driven roller 25B. Then, when the drive roller 25A is rotated, the printing paper 21 is transported according to the direction of rotation. The driven roller 25B is also rotated with the transport of the printing paper 21.

The EX roller pair 27 includes a drive roller 27A arranged on the lower side of the first transporting path 17 and a spur 27B arranged on the upper side thereof. Although the detailed description will be given later, the drive roller 27A is rotated by the drive transmission from the first drive motor 41. The spur 27B is provided so as to be movable toward and away from the drive roller 27A, and is resiliently urged toward the drive roller 27A. The spur 27B has a shape of a disk having a circumference including peaks and troughs continuing alternately, and tips of the peaks come into contact with the printing paper 21. When the spur 27B is retracted from the drive roller 27A by the extent corresponding to the thickness of the printing paper 21, and urges the printing paper 21 toward the drive roller 27A, the printing paper 21 is held between the drive roller 27A and the spur 27B. Then, when the drive roller 27A is rotated, the printing paper 21 is transported according to the direction of rotation. The spur 27B is also rotated with the transport of the printing paper 21. The spur 27B comes into contact with a surface of the printing paper 21 having subjected to the image printing by the printing unit 26 immediately before. However, as described before, since contact with the printing paper 21 is achieved only at the tips of the peaks, deterioration of the printed image does not occur.

The SB roller pair 28 includes a drive roller 28A arranged on the lower side of the first transporting path 17 and a spur 28B arranged on the upper side thereof. Although the detailed description will be given later, the drive roller 28A is rotated by the drive transmission from the first drive motor 41. The spur 28B is provided so as to be movable toward and away from the drive roller 28A, and is resiliently urged toward the drive roller 28A. The spur 28B has a shape of a disk having a circumference including peaks and troughs continuing alternately, and tips of the peaks come into contact with the printing paper 21. When the spur 28B is retracted from the drive roller 28A by the extent corresponding to the thickness of the printing paper 21, and urges the printing paper 21 toward the drive roller 28A, the printing paper 21 is held between the drive roller 28A and the spur 28B. Then, when the drive roller 28A is rotated, the printing paper 21 is transported according to the direction of rotation. The spur 28B is also rotated with the transport of the printing paper 21. The spur 28B comes into contact with the surface of the printing paper 21 having subjected to the image printing by the printing unit 26 immediately before. However, as described before, since contact with the printing paper 21 is achieved only at the tips of the peaks, deterioration of the printed image does not occur.

The DX roller pair 29 includes a drive roller 29A arranged on a lower side of the second transporting path 20 and a driven roller 29B arranged on an upper side thereof. Although the detailed description will be given later, the drive roller 29A is rotated by the drive transmission from the second drive motor 42. The driven roller 29B is provided so as to be movable toward and away from the drive roller 29A, and is resiliently urged toward the drive roller 29A. When the driven roller 29B is retracted from the drive roller 29A by the extent corresponding to the thickness of the printing paper 21, and urges the printing paper 21 toward the drive roller 29A, the printing paper 21 is held between the drive roller 29A and the driven roller 29B. Then, when the drive roller 29A is rotated, the printing paper 21 is transported according to the direction of rotation. The driven roller 29B is also rotated with the transport of the printing paper 21. The driven roller 29B comes into contact with the surface of the printing paper 21 having subjected to the image printing by the printing unit 26 immediately before.

The printing unit 26 includes a carriage 31 arranged on the upper side of the first transporting path 17 and a platen 32 arranged on the lower side thereof. Mounted on the carriage 31 is a printhead 35 for performing the image printing by the ink-jet printing system in a state of opposing the platen 32. The carriage 31 is reciprocated together with the printhead 35 in the direction orthogonal to the first direction 101. During the reciprocal movement of the carriage 31, minute ink droplets are selectively discharged in the direction from the printhead 35 toward the platen 32. The discharged ink droplets drop onto the printing paper 21 supported on the platen 32. By the transport of the printing paper 21 in the first direction 101 and the reciprocal movement of the carriage 31 repeated alternately, a desired image is printed on the printing paper 21.

Figure 3:
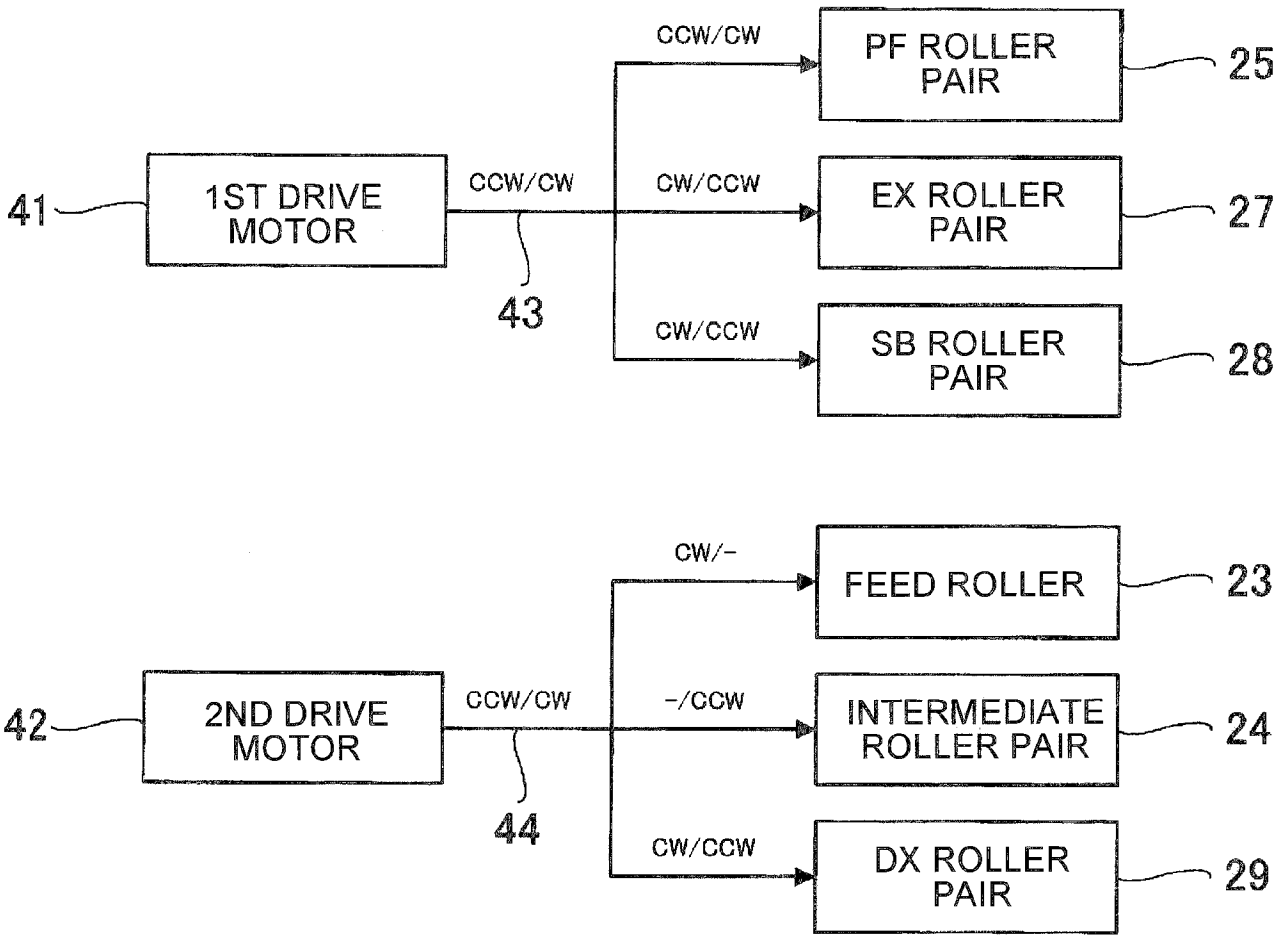
FIG. 3 is a block diagram showing a drive transmission from a first drive motor and a second drive motor.

As shown in FIG. 3, the printer unit 11 includes the first drive motor 41 and the second drive motor 42. The first drive motor 41 and the second drive motor 42 are blushless DC motors which are rotatable in the normal direction and the reverse direction.

The normal rotation or the reverse rotation of the first drive motor 41 is transmitted to the PF roller pair 25, the EX roller pair 27, and the SB roller pair 28 via a transmitting mechanism 43 (an example of a first transmitting mechanism), thus forming an example of a first transporting mechanism. In FIG. 3, the transmitting mechanism 43 is illustrated with a line. However, the transmitting mechanism 43 is a gear train configured with gears or belts, and the direction of rotation to be transmitted from the first drive motor 41 to the PF roller pair 25, the EX roller pair 27, and the SB roller pair 28 is set depending on the number of the gears. Consequently, assuming that a direction of the normal rotation of the first drive motor 41 is CCW (counterclockwise) and a direction of the reverse rotation is CW (clockwise), the normal rotation of the first drive motor 41 is transmitted as the normal rotation CCW of the PF roller pair 25 to the drive roller 25A, and is transmitted as the reverse rotations CW of the EX roller pair 27 and the SB roller pair 28 to the drive rollers 27A and 28A, respectively. The reverse rotation of the first drive motor 41 is transmitted as the reverse rotation CW of the PF roller pair 25 to the drive roller 25A, and is transmitted as the normal rotations CCW of the EX roller pair 27 and the SB roller pair 28 to the drive rollers 27A and 28A, respectively. The rotations of the receptive drive rollers, namely, the PF roller pair 25, the EX roller pair 27, and the SB roller pair 28 are synchronized, and the respective drive rollers are rotated at the substantially same peripheral speed.

The normal rotation or the reverse rotation of the second drive motor 42 is transmitted to the paper feed roller 23, the intermediate roller pair 24, and the DX roller pair 29 via a transmitting mechanism 44 (an example of a second transmitting mechanism), thus forming an example of a second transporting mechanism. In FIG. 3, the transmitting mechanism 44 is illustrated with a line. However, the transmitting mechanism 44 is the gear train configured with the gears or the belts. The direction of rotation to be transmitted from the second drive motor 42 to the paper feed roller 23, the intermediate roller pair 24, and the DX roller pair 29 is set depending on the number of gears, and the drive transmission or disconnection from the second drive motor 42 to the paper feed roller 23 or the intermediate roller pair 24 is set by a swing gear. Consequently, assuming that the direction of the normal direction of the second drive motor 42 is CCW and the direction of the reverse rotation of the second drive motor 42 is CW, the normal rotation of the second drive motor 42 is transmitted as the reverse rotation (CW) to the paper feed roller 23, and is transmitted as the reverse rotation (CW) of the DX roller pair 29 to the drive roller 29A. Then, the normal rotation of the second drive motor 42 is not transmitted to the intermediate roller pair 24. The reverse rotation of the second drive motor 42 is transmitted as the normal rotations (CCW) of the intermediate roller pair 24 and the DX roller pair 29 to the drive rollers 24A and 29A, respectively. Then, the reverse rotation of the second drive motor 42 is not transmitted to the paper feed roller 23. The normal rotation and the reverse rotation in each of the first drive motor 41 and the second drive motor 42 are a concept having a relative relationship. Therefore, which one of them is rotated in the normal direction (CCW) or in the reverse direction (CW) makes any difference.

A transporting force F1 of the SB roller pair 28 to transport the printing paper 21 in the first direction 101 by the drive transmission from the first drive motor 41 is smaller than a transporting force F2 of the DX roller pair 29 to transport the printing paper 21 in the third direction 103 by the drive transmission from the second drive motor 42 (transporting force F1<transporting force F2).

The term "transporting force" means a force required for bringing the printing paper 21 into standstill against the rotation of the SB roller pair 28 or the DX roller pair 29 when the SB roller pair 28 or the DX roller pair 29 holds the printing paper 21 and is rotated to transport the printing paper 21 in the first direction 101 or the third direction 103, or a force required for pulling out the printing medium held by the SB roller pair 28 or the DX roller pair 29 from the transporting roller pair in a state in which the SB roller pair 28 or the DX roller pair 29 is completely fixed so as not to be rotated. This force is expressed in a unit of Newton. The "transporting force" varies depending on the force of the SB roller pair 28 or the DX roller pair 29 holding the printing paper 21, or a frictional force between the SB roller pair 28 or the DX roller pair 29 and the printing paper 21.

In the embodiment, the outer diameter of the drive roller 29A of the DX roller pair 29 is larger than the outer diameter of the drive roller 28A of the SB roller pair 28. The hardness of the rubber used for a roller surface of the drive roller 29A is smaller than the hardness of the rubber used for a roller surface of the drive roller 28A. Consequently, the contact area of the drive roller 29A with respect to the printing paper is larger than that of the drive roller 28A.

[Action of Printer Unit 11]

The image printing by the printer unit 11 will be described below. When the image printing is performed only on the first surface of the printing paper 21, the printing paper 21 transported from the paper feed tray 15 to the first transporting path 17 by the paper feed roller 23 is transported by the intermediate roller pair 24 and the PF roller pair 25 onto the platen 32. The printhead 35 making a reciprocal movement together with the carriage 31 discharges ink selectively toward the printing paper 21 which is stopped temporarily on the platen 32. By the repetition of the intermittent transport of the printing paper 21 and the reciprocal movement of the carriage 31, an image is printed on the first surface of the printing paper 21. The printing paper 21 passed through the platen 32 is discharged from the first transporting path 17 to the paper discharge tray 16 by the EX roller pair 27 and the SB roller pair 28.

A case where the image printing is performed on the first surface and the second surface of the printing paper 21 will be described below. When the second drive motor 42 rotates in the normal direction (CCW), the paper feed roller 23 is rotated in the reverse direction (CW), and the drive roller 29A of the DX roller pair 29 is rotated in the reverse direction (CW). With the rotation of the paper feed roller 23 as described above, the printing paper 21 is fed from the paper feed tray 15 to the first transporting path 17. A leading edge of the fed printing paper 21 reaches the intermediate roller pair 24. The intermediate roller pair 24 is stopped without receiving the drive transmission from the second drive motor 42 in the normal rotation CCW. When the leading edge of the printing paper 21 comes into abutment with the intermediate roller pair 24 in a stopped state, the skew of the printing paper 21 is corrected.

When the leading edge of the printing paper 21 reaches the intermediate roller pair 24, the rotation of the second drive motor 42 is switched from the normal rotation (CCW) to the reverse rotation (CW). Accordingly, the drive roller 24A of the intermediate roller pair 24 is rotated in the normal direction (CCW), and the drive roller 29A of the DX roller pair 29 is rotated in the normal direction (CCW). The leading edge side of the printing paper 21 is held by the intermediate roller pair 24, and the printing paper 21 is transported on the first transporting path 17 in the first direction 101, and the leading edge reaches the PF roller pair 25. Whether or not the leading edge of the printing paper 21 reaches the intermediate roller pair 24 can be sensed by a sensor arranged on the first transporting path 17 on the upstream side of the intermediate roller pair 24 in the first direction 101, although the sensor is not illustrated.

The drive roller 25A of the PF roller pair 25 is rotated in the reverse direction (CW) by the reverse rotation (CW) of the first drive motor 41. The direction of rotation of the drive roller 25A is a direction of rotation for transporting the printing paper 21 in the second direction 102. Therefore, the leading edge of the printing paper 21 comes into abutment with the PF roller pair 25 without being held by the PF roller pair 25. Accordingly, the skew of the printing paper 21 is corrected.

When the leading edge of the printing paper 21 reaches the PF roller pair 25, the rotation of the first drive motor 41 is switched from the reverse rotation (CW) to the normal rotation (CCW) while the second drive motor 42 rotates in the reverse direction (CW). Accordingly, the drive roller 25A of the PF roller pair 25 is rotated in the normal direction (CCW) and the drive rollers 27A and 28A of the EX roller pair 27 and the SB roller pair 28 are rotated in the reverse direction (CW). The directions of rotation of the drive rollers 25A, 27A, and 28A are the direction of rotation for transporting the printing paper 21 in the first direction 101. The drive roller 29A of the DX roller pair 29 is rotated in the direction of rotation for transporting the printing paper 21 in the third direction 103. However, the DX roller pair 29 does not hold the printing paper 21 at this timing.

Whether or not the leading edge of the printing paper 21 reaches the PF roller pair 25 can be sensed by a sensor arranged on the first transporting path 17 on the upstream side of the PF roller pair 25 in the first direction 101, although the sensor is not illustrated.

Figure 4:
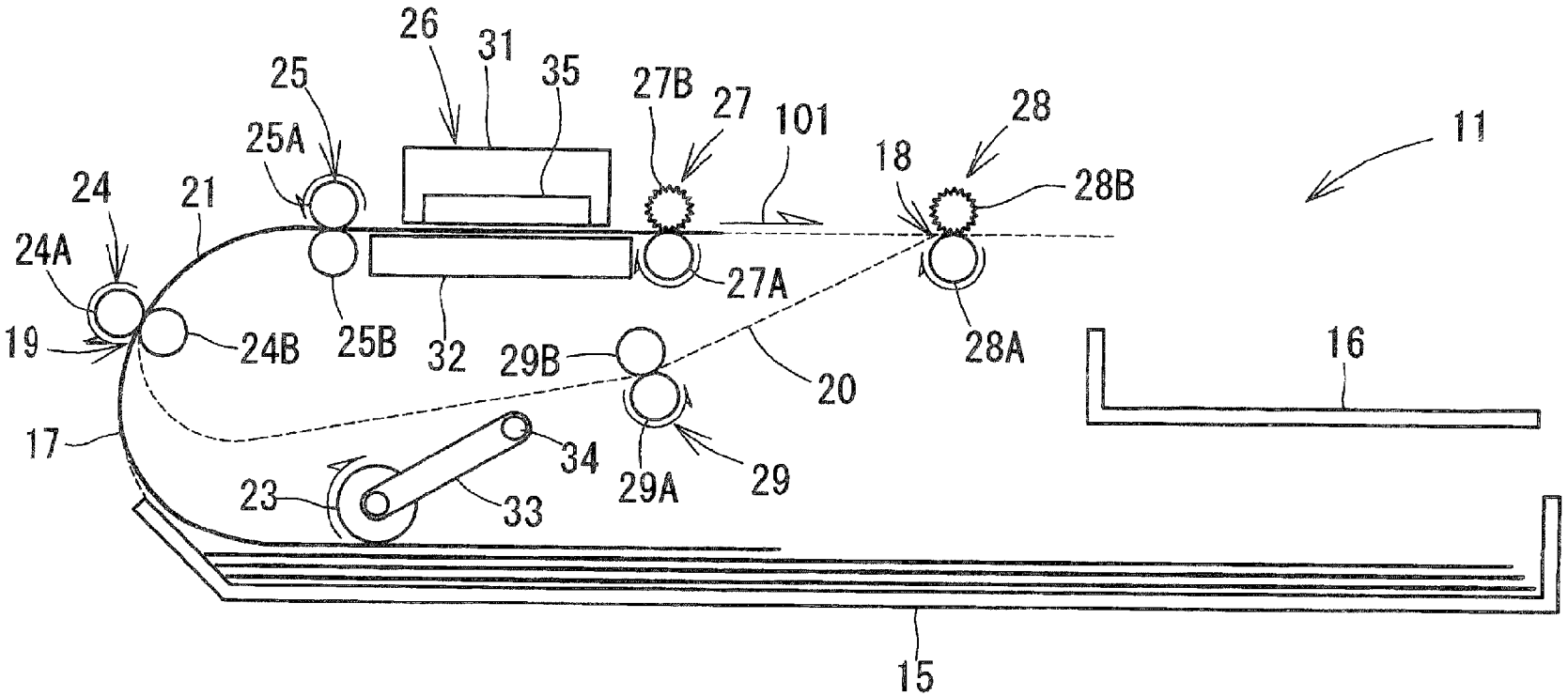
FIG. 4 is a diagrammatic drawing showing an action of duplex printing by the printer unit.

As shown in FIG. 4, the leading edge side of the printing paper 21 is held by the PF roller pair 25, and the printing paper 21 is transported in the first direction 101. When the leading edge of the printing paper 21 reaches the platen 32, the first drive motor 41 rotates intermittently in the normal direction (CCW), and the second drive motor 42 rotates intermittently in the reverse direction (CW). The intermittence of the first drive motor 41 and the intermittence of the second drive motor 42 are synchronized. Accordingly, the drive rollers 24A and 25A of the intermediate roller pair 24 and the PF roller pair 25 are rotated intermittently in the normal direction (CCW) and the drive rollers 27A and 28A of the EX roller pair 27 and the SB roller pair 28 are rotated intermittently in the reverse direction (CW). Upon receipt of this rotation, the printing paper 21 is transported intermittently in the first direction 101.

As described above, the carriage 31 is reciprocated and the ink droplets are discharged selectively from the printhead 35 while the printing paper 21 is transported intermittently. When the ink droplets are dropped on the printing paper 21, an image is printed on the first surface of the printing paper 21.

The trailing edge of the printing paper 21 being subjected to the image printing on the first surface passes through the PF roller pair 25 by being transported on the first transporting path 17 in the first direction 101. Then, when the trailing edge of the printing paper 21 passes over the platen 32, the image printing on the first surface of the printing paper 21 is completed. When the trailing edge of the printing paper 21 passes over the platen 32, the first drive motor 41 rotates continuously in the normal direction (CCW), and the second drive motor 42 rotates continuously in the reverse direction (CW). Accordingly, the drive rollers 24A and 25A of the intermediate roller pair 24 and the PF roller pair 25 are rotated continuously in the normal direction (CCW) and, the drive rollers 27A and 28A of the EX roller pair 27 and the SB roller pair 28 are rotated continuously in the reverse direction (CW). Upon receipt of this rotation, the printing paper 21 is transported continuously in the first direction 101. Whether or not the trailing edge of the printing paper 21 passes over the platen 32 can be sensed by a sensor arranged on the first transporting path 17 on the upstream side of the PF roller pair 25 in the first direction 101.

Figure 5:
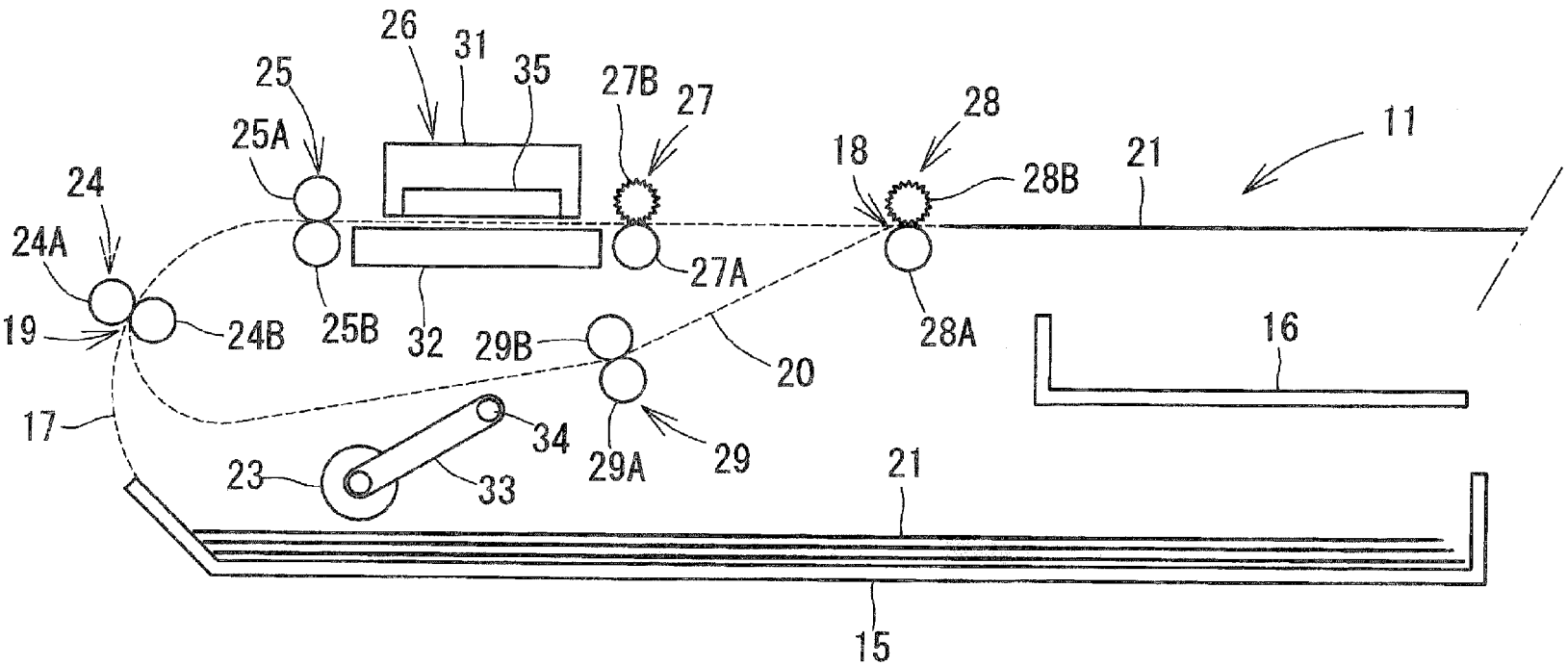
FIG. 5 is a diagrammatic drawing showing the action of duplex printing by the printer unit.
Figure 6:
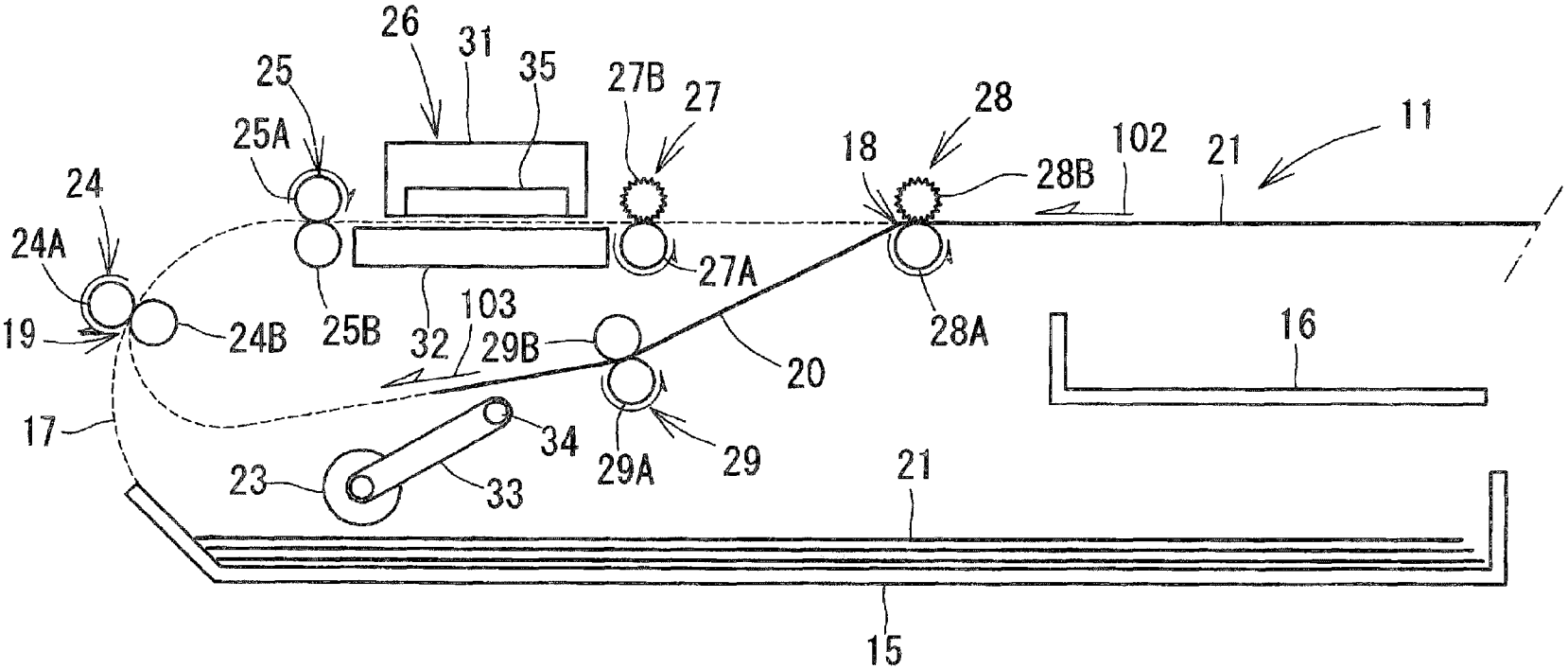
FIG. 6 is a diagrammatic drawing showing the action of duplex printing by the printer unit.

As shown in FIG. 5, the first drive motor 41 and the second drive motor 42 are stopped before the trailing edge of the printing paper 21 passes the downstream position 18 on the first transporting path 17, and passes the SB roller pair 28. Accordingly, the printing paper 21 is stopped in a state of being held at the trailing edge side by the SB roller pair 28. At this time, the leading edge side of the printing paper 21 projects from the first transporting path 17 toward the paper discharge tray 16. In FIGS. 5 and 6, the leading edge side of the printing paper 21 projecting from the first transporting path 17 is partly omitted. Whether or not the trailing edge of the printing paper 21 has passed the downstream position 18 can be sensed by a sensor arranged on the first transporting path 17 on the upstream side of the downstream position 18 in the first direction 101, although the sensor is not illustrated.

Subsequently, the first drive motor 41 rotates in the reverse direction (CW) and the second drive motor 42 rotates in the reverse direction (CW). Accordingly, the drive rollers 24A and 29A of the intermediate roller pair 24 and the DX roller pair 29 are rotated in the normal direction (CCW), the drive roller 25A of the PF roller pair 25 is rotated in the reverse direction (CW), and the drive rollers 27A and 28A of the EX roller pair 27 and the SB roller pair 28 are rotated in the normal direction (CCW). Upon receipt of this rotation, the printing paper 21 is transported on the first transporting path 17 in the second direction 102.

As show in FIG. 6, when the leading edge of the printing paper 21 transported in the second direction 102 reaches the downstream position 18, the leading edge of the printing paper 21 enters the second transporting path 20. Switching of the transporting path can be realized by providing a flap at the downstream position 18, and rotating the flap at a predetermined timing. The switching of the transporting path, however, is known, and hence detailed description is omitted.

The leading edge of the printing paper 21 entered the second transporting path 20 from the downstream position 18 is transported in the third direction 103 and reaches the DX roller pair 29. Since the drive roller 29A of the DX roller pair 29 is rotated in the normal direction (CCW), the leading edge side of the printing paper 21 is held by the DX roller pair 29 and is transported in the third direction 103.

The leading edge of the printing paper 21 transported on the second transporting path 20 in the third direction 103 reaches the upstream position 19 of the first transporting path 17, and enters the first transporting path 17. Since the drive roller 24A of the intermediate roller pair 24 is rotated in the normal direction (CCW), the leading edge side of the printing paper 21 is held by the intermediate roller pair 24 and is transported on the first transporting path 17 in the third direction 101.

The leading edge side of the printing paper 21 is held by the intermediate roller pair 24, and the printing paper 21 having printed on the first surface thereof is transported on the first transporting path 17 in the first direction 101 in a position in which the second surface is directed to the outside of the curve, and the leading edge and the trailing edge are reversed from the position in which the image printing is performed on the first surface. Then, the leading edge of the printing paper 21 in a position in which the second surface is directed to the outside of the curve (the trailing edge when the image printing is performed on the first surface) reaches the PF roller pair 25.

The drive roller 25A of the PF roller pair 25 is rotated in the reverse direction (CW) by the reverse rotation CW of the first drive motor 41. The direction of rotation of the drive roller 25A is the direction of rotation for transporting the printing paper 21 in the second direction 102. Therefore, the leading edge of the printing paper 21 comes into abutment with the PF roller pair 25 without being held by the PF roller pair 25. Accordingly, the skew of the printing paper 21 is corrected.

Figure 7:
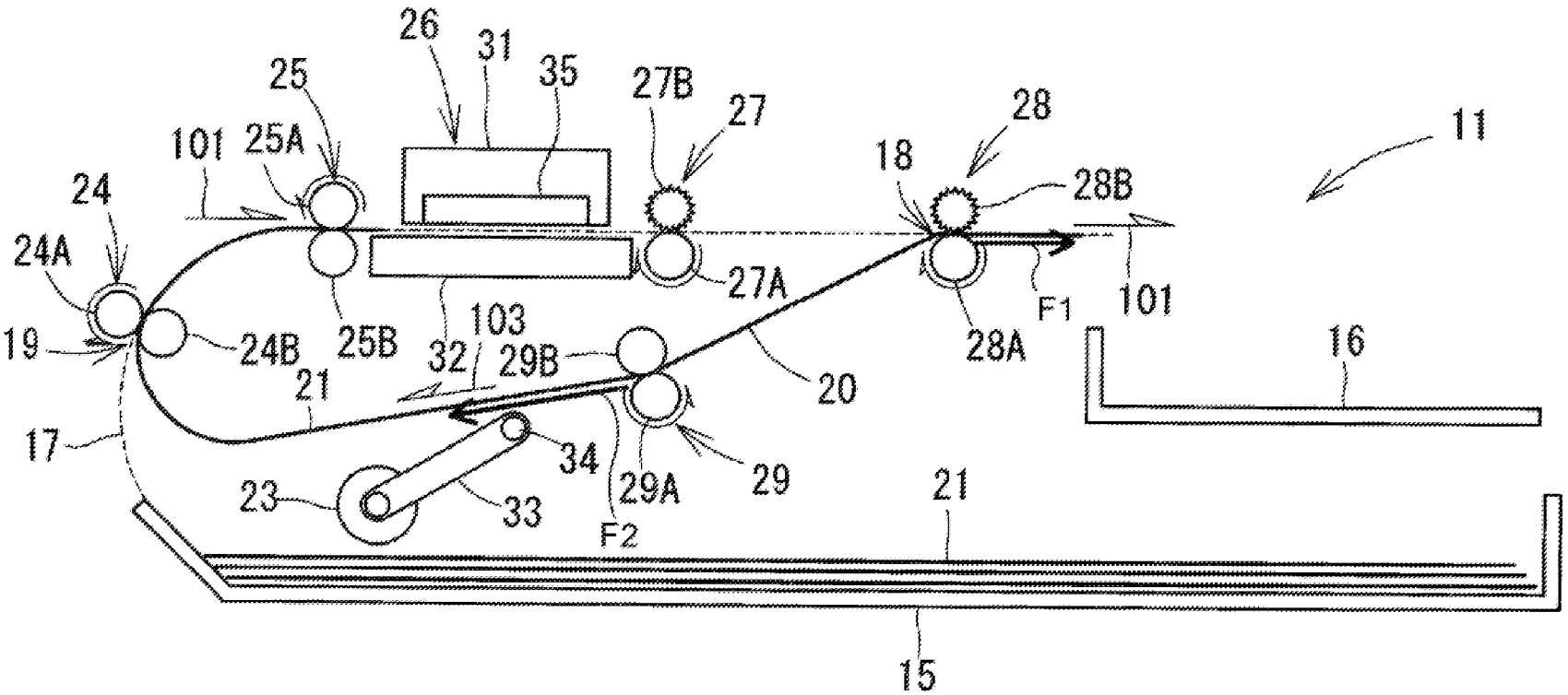
FIG. 7 is a diagrammatic drawing showing the action of duplex printing by the printer unit.

As shown in FIG. 7, when the leading edge of the printing paper 21 reaches the PF roller pair 25, the rotation of the first drive motor 41 is switched from the reverse direction (CW) to the normal direction (CCW) while the second drive motor 42 rotates in the reverse direction (CW). Accordingly, the drive roller 25A of the PF roller pair 25 is rotated in the normal direction (CCW) and the drive rollers 27A and 28A of the EX roller pair 27 and the SB roller pair 28 are rotated in the reverse direction (CW). The directions of rotation of the drive rollers 25A, 27A, and 28A are the direction of rotation for transporting the printing paper 21 in the first direction 101. The drive roller 29A of the DX roller pair 29 is rotated in the direction of rotation for transporting the printing paper 21 in the third direction 103.

If the length of the printing paper 21 in the direction of transport is longer than the length of the transporting route from the SB roller pair 28 to the PF roller pair 25 via the downstream position 18, the second transporting path 20, and the upstream position 19, the trailing edge side of the printing paper 21 is held by the SB roller pair 28 when the leading edge side of the printing paper 21 is held by the PF roller pair 25 and transported in the first direction 101. Then, since the SB roller pair 28 transports the trailing edge side of the printing paper 21 in the first direction 101, and the DX roller pair 29 transports the printing paper 21 in the third direction 103. Therefore, the printing paper 21 is pulled by both the SB roller pair 28 and the DX roller pair 29 in the opposite directions.

Figure 8:
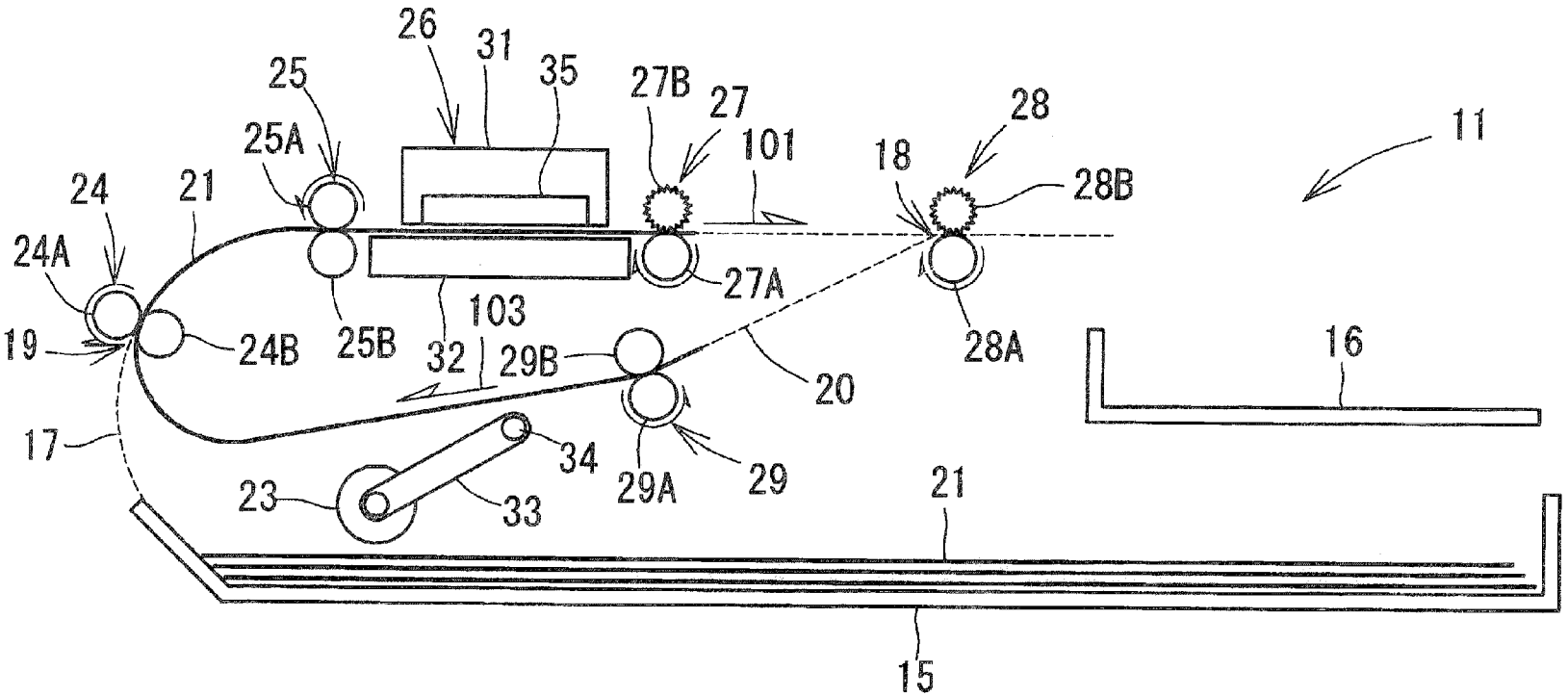
FIG. 8 is a diagrammatic drawing showing the action of duplex printing by the printer unit.

As described above, the transporting force F1 of the SB roller pair 28 for transporting the printing paper 21 in the first direction 101 is smaller than the transporting force F2 of the DX roller pair 29 to transport the printing paper 21 in the third direction 103 (transporting force F1<transporting force F2). Therefore, the SB roller pair 28 slips with respect to the printing paper 21 and the printing paper 21 is transported by the DX roller pair 29 in the third direction 103. Accordingly, as shown in FIG. 8, the trailing edge side of the printing paper 21 passes throughout in the third direction 103 against the SB roller pair 28 the drive roller 28A of which is rotated in the reverse direction (CW). Even when the printing paper 21 has a maximum size which is available for the duplex printing in the printer unit 11, since the first transporting path 17 and the second transporting path 20 have a length which does not allow the SB roller pair 28 to hold the leading edge side and the trailing edge side of the printing paper 21 simultaneously, the leading edge of the printing paper 21 does not reach the SB roller pair 28 before the trailing edge side of the printing paper 21 passes throughout the SB roller pair 28. In other words, the length of the longest printing medium for the duplex printing is smaller than a length from the SB roller pair 28 to the SB roller pair 28 circulating via the DX roller pair 29 and the PF roller pair 25.

When the leading edge of the printing paper 21 reaches the platen 32 with the second surface faced toward the printhead 35, the first drive motor 41 rotates intermittently in the normal direction (CCW), and the second drive motor 42 rotates intermittently in the reverse direction (CW). Then, in the same manner as the image printing on the first surface, the carriage 31 is reciprocated and ink droplets are discharged selectively from the printhead 35 while the printing paper 21 is transported intermittently. When the ink droplets are dropped on the printing paper 21, an image is printed on the second surface of the printing paper 21.

When the image printing on the second surface of the printing paper 21 is terminated, the first drive motor 41 rotates continuously in the normal direction (CCW), and the second drive motor 42 rotates continuously in the reverse direction (CW). Accordingly, the drive rollers 24A and 25A of the intermediate roller pair 24 and the PF roller pair 25 are rotated continuously in the normal direction (CCW), and the drive rollers 27A and 28A of the EX roller pair 27 and the SB roller pair 28 are rotated continuously in the reverse direction (CW). Upon receipt of this rotation, the printing paper 21 is transported continuously in the first direction 101, and is discharged from the first transporting path 17 onto the paper discharge tray 16.

[Advantages of Embodiment]

As described above, according to the printer unit 11, even when the SB roller pair 28 is rotated so as to transport the printing paper 21 in the first direction 101 and the DX roller pair 29 is rotated so as to transport the printing paper 21 in the third direction 103 in so-called the duplex printing, the transporting force F1 of the SB roller pair 28 to transport the printing paper 21 in the first direction 101 is smaller than the transporting force F2 of the DX roller pair 29 to transport the printing paper 21 in the third direction 103 (transporting force F1<transporting force F2), and hence the SB roller pair 28 slips with respect to the printing paper 21, the printing paper 21 is transported by the DX roller pair 29 in the third direction 103, and the trailing edge of the printing paper 21 is passed throughout the SB roller pair 28 in the second direction 102. Accordingly, the transport suitable to the duplex printing on the printing paper 21 elongated in the direction of transport is achieved smoothly without increasing cost of the device or increasing length of the transporting route.

Since the DX roller pair 29 is configured such that the drive roller 29A is arranged on the side opposing the second surface opposite from the first surface of the printing paper 21 on which an image is printed first by the printing unit 26, even when the drive roller 29A is brought into strongly contact with the printing paper 21 to achieve the relationship; the transporting force F1<the transporting force F2, the deterioration of the image printed on the first surface of the printing paper 21 is avoided.

Since the transporting route of the second transporting path 20 from the SB roller pair 28 to the DX roller pair 29 is a linear shape, even when the printing paper 21 is pulled by both the SB roller pair 28 and the DX roller pair 29 in the opposite directions, the printing paper 21 is not pressed against the guide surface or the like of the second transporting path 20. Accordingly, deterioration of the image printed on the first surface is avoided, and the damage of the printing paper 21 is also avoided.

Since the intermediate roller pair 24 is provided on the first transporting path 17 between the upstream position 19 and the PF roller pair 25, even when the SB roller pair 28 transports the trailing edge side of the printing paper 21 in the first direction 101 so that a load is generated against the transport of the printing paper 21 by the PF roller pair 25 in the first direction 101, since the two roller pairs, namely the DX roller pair 29 and the intermediate roller pair 24 hold and transport the printing paper 21 in the third direction 103 or in the first direction 101 between the SB roller pair 28 and the PF roller pair 25, so that the load is restrained from affecting the transporting accuracy of the PF roller pair 25.

The effects and advantages described above are effective in the printer unit 11 designed in such a manner that the dimension of the largest printing paper 21 which is available for the duplex printing along the direction of transport is larger than the length of the transporting route from the PF roller pair 25 to the SB roller pair 28 through the upstream position 19, the second transporting path 20, and the downstream position 18.

The first transporting path 17 and the second transporting path 20 have a length which does not allow the SB roller pair 28 to hold the leading edge side and the trailing edge side of the largest printing paper 21 transported for the duplex printing simultaneously, so that paper jam in the duplex printing is avoided.

[Modification]

Figure 9:
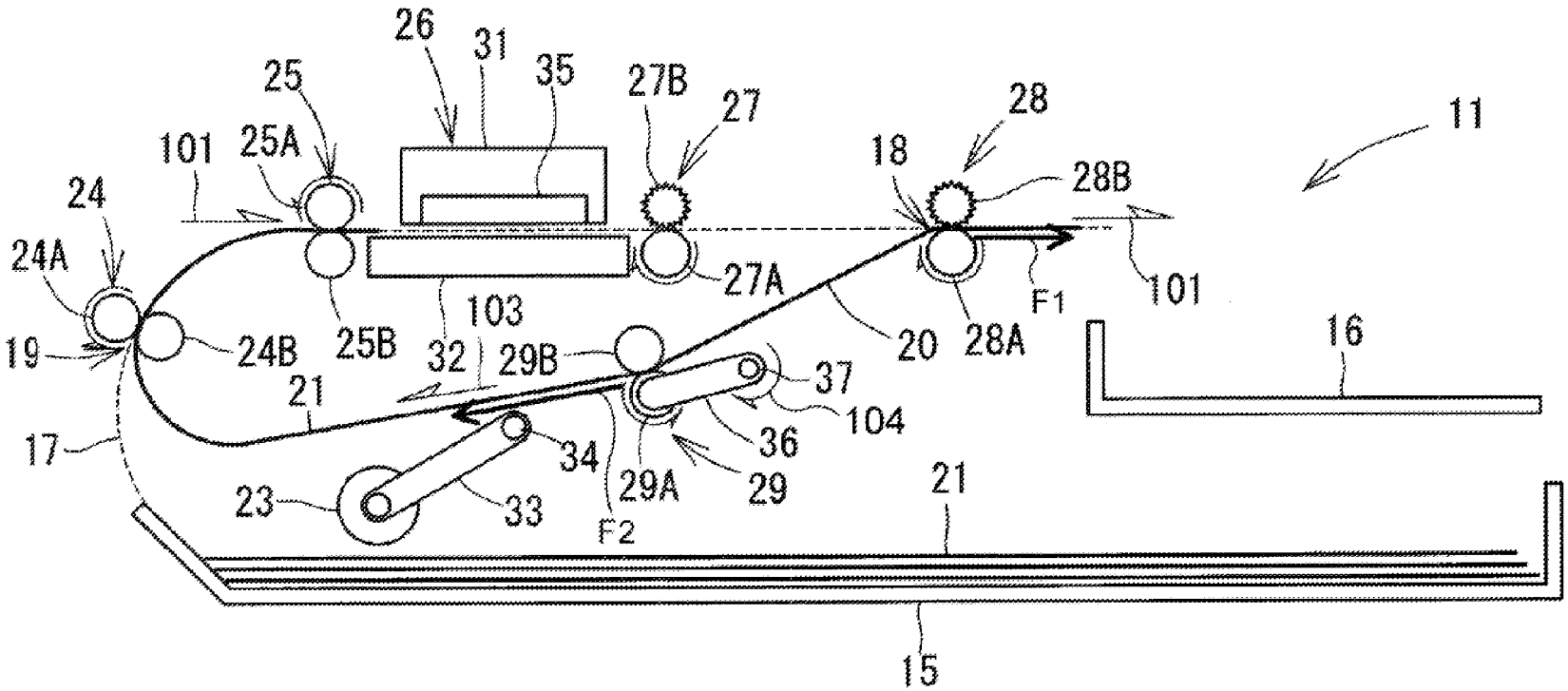
FIG. 9 is a diagrammatic drawing showing a modification of the printer unit.

In the embodiment described above, the drive roller 29A of the DX roller pair 29 is rotated with the shaft fixed to the frame of the device, for example. However, as shown in FIG. 9, the drive roller 29A may be supported on the distal end side of an arm 36.

Specifically, the arm 36 rotatably supports the drive roller 29A on the distal end side and the distal end side projects toward the second transporting path 20 in the third direction 103 with respect to the proximal end side. The arm 36 is rotatable about a shaft 37 provided on the proximal side. The drive roller 29A is movable in the direction toward and away from the driven roller 29B by the rotation of the arm 36.

In the modification as well, the outer diameter of the drive roller 29A of the DX roller pair 29 is larger than the outer diameter of the drive roller 28A of the SB roller pair 28. The hardness of the rubber used for the roller surface of the drive roller 29A is smaller than the hardness of the rubber used for the roller surface of the drive roller 28A. Consequently, the contact area of the drive roller 29A with respect to the printing paper is larger than that of the drive roller 28A.

As described above, in the duplex printing by the printer unit 11, when the SB roller pair 28 is rotated so as to transport the printing paper 21 in the first direction 101 and the DX roller pair 29 is rotated so as to transport the printing paper 21 in the third direction 103, the printing paper 21 is pulled by the SB roller pair 28 and the DX roller pair 29 in the opposite directions.

When the printing paper 21 is about to move in the direction opposite from the third direction 103 against the rotation of the drive roller 29A of the DX roller pair 29 in the normal direction (CCW), the arm 36 turns in a clockwise direction (CW) 104 by the friction between the drive roller 29A and the printing paper 21. When the drive roller 29A is pressed against the printing paper 21 further strongly due to the turn of the arm 36, the frictional force between the drive roller 29A and the printing paper 21 is increased. The transporting force F2 includes the turn of the arm 36, and is a force required for bringing the printing paper 21 into standstill against the transport by the DX roller pair 29 in the third direction 103 in a state in which the force of bringing the drive roller 29A into press contact with the printing paper 21 by the turn of the arm 36 is increased. The transporting force F2 may be specified as a force to pull out the printing paper 21 from the DX roller pair 29 in a state in which the rotation of the DX roller pair 29 is fixed with the arm 36 allowed to be freely rotatable and a force of the drive roller 29A to come into press contact with the printing paper 21 by the turn of the arm 36 is increased. In the modification, the transporting force F2 by the DX roller pair 29 is on the order of ten times the transporting force F1 by the SB roller pair 28.

Accordingly, when the dimension of the printing paper 21 in the direction of transport is relatively short and the printing paper 21 is not pulled by the SB roller pair 28 and the DX roller pair 29 in the opposite directions in the duplex printing, the forces of the drive roller 29A and the driven roller 29B coming into press contact with each other can be reduced to restrain the DX roller pair 29 from holding the printing paper 21 with a strong force. Accordingly, the driven roller 29B is not brought into press contact with the first surface of the printing paper 21 with a strong force, and hence the deterioration of the image printed on the first surface can further be restrained.

In contrast, when the dimension of the printing paper 21 in the direction of transport is relatively long and the printing paper 21 is pulled by the SB roller pair 28 and the DX roller pair 29 in the opposite directions in the duplex printing, the forces of the drive roller 29A and the driven roller 29B coming into press contact with each other is increased by the turn of the arm 36 so that the DX roller pair 29 holds the printing paper 21 with a strong force. Accordingly, the trailing edge side of the printing paper 21 held by the SB roller pair 28 can be removed out in the third direction 103 quickly by increasing the transporting force F2 of the DX roller pair 29.

What is claimed is:

1. An image printing device comprising:

a first transporting mechanism configured to transport a printing medium along a first path;

a printing unit configured to perform image printing on the printing medium transported by the first transporting mechanism; and a second transporting mechanism configured to transport the printing medium, which is transported by first transporting mechanism and is performed image printing on a first surface thereof by the printing unit, to the first transporting mechanism along a second path;

wherein the first transporting mechanism includes:

first transporting rollers disposed at a position upstream of the printing unit and configured to transport the printing medium toward the printing unit;

second transporting rollers disposed at a position downstream of the printing unit and configured to transport the printing medium, which is performed the image printing on the first surface thereof, in a first direction and then in a second direction opposite to the first direction;

a first drive motor which rotates in a first rotational direction and a second rotational direction; and a transmitting mechanism configured to transmit a rotation in the first rotational direction of the first drive motor to both the first transporting rollers and the second transporting rollers such that the first transporting rollers transport the printing medium toward the printing unit and the second rollers transport the printing medium in the first direction along the first path, and further configured to transmit a rotation in the second rotation direction of the first drive motor to both the first transporting rollers and the second transporting rollers such that the second transporting rollers transport the printing medium in the second direction, wherein the second transporting mechanism includes:

a second drive motor; and third transporting rollers configured to be driven by the second drive motor and configured to transport the printing medium, which is transported in the second direction by the second transporting rollers, toward the first transporting rollers along the second path;

wherein a transporting force of the second transporting rollers for transporting the printing medium in the first direction is smaller than a transporting force of the third transporting rollers for transporting the printing medium.

2. The image printing device according to claim 1, wherein the third transporting rollers includes a drive roller configured to be driven by the second drive motor and a driven roller configured to be driven by the drive roller, wherein the drive roller configured to contact and drive a second surface of the printing medium opposite to the first surface on which the image printing is performed by the printing unit.

3. The image printing device according to claim 2, wherein the third transporting rollers further includes an arm which supports the drive roller at a distal end thereof and rotates about an axis at a proximal end thereof.

4. The image printing device according to claim 1, wherein a portion of the second path from the second transporting rollers to the third transporting rollers extends linearly.

5. The image printing device according to claim 1, further comprising fourth transporting rollers disposed upstream of the first transporting rollers and configured to transport the printing medium toward the first transporting rollers.

6. The image printing device according to claim 1, wherein the image printing device transports a longest printing medium along the second path, the longest printing medium has a length greater than a length from the second transporting rollers to the first transporting rollers via the third transporting rollers along the second path.

7. The image printing device according to claim 6, wherein the length of the longest printing medium is smaller than a length from the second transporting rollers to the second transporting rollers circulating via the third transporting rollers and the first transporting rollers along the second path and the first path.

8. The image printing device according to claim 1, wherein the first transporting mechanism further includes a fifth transporting rollers disposed downstream of the printing unit and between the first transporting rollers and second transporting rollers, and configured to transport the printing medium toward the second transporting rollers.

9. The image printing device according to claim 1, wherein the second transporting rollers transports again, in the first direction, the printing medium which is transported by the third transporting rollers, is transported again by the first transporting again and is performed image printing on a second surface opposite to the first surface.

10. The image printing device according to claim 1, wherein the image printing device further comprises a feed tray which accommodates the printing medium and a feed roller which feeds the printing medium toward the first transporting rollers, and the third transporting rollers are disposed between the first path and the feed tray.

* * * * *